US008263886B2

(12) United States Patent
Lin et al.

(10) Patent No.: US 8,263,886 B2
(45) Date of Patent: Sep. 11, 2012

(54) KEY MECHANISM WITH WATERPROOFING FUNCTION AND RELATED ELECTRONIC DEVICE

(75) Inventors: Yung-Feng Lin, Taipei Hsien (TW); Mei-Hui Chen, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 239 days.

(21) Appl. No.: 12/761,402

(22) Filed: Apr. 16, 2010

(65) Prior Publication Data

US 2011/0005908 A1 Jan. 13, 2011

(30) Foreign Application Priority Data

Jul. 13, 2009 (TW) ..... 98123591 A

(51) Int. Cl.
*H01H 13/06* (2006.01)

(52) U.S. Cl. ..... 200/302.2

(58) Field of Classification Search ..... 200/302.2, 200/302.1, 302.3, 512–520, 310–315
See application file for complete search history.

(56) References Cited

U.S. PATENT DOCUMENTS

| | | | | |
|---|---|---|---|---|
| 6,166,662 | A * | 12/2000 | Chuang | 341/22 |
| 7,282,657 | B2 * | 10/2007 | Wimmer et al. | 200/302.2 |
| 7,365,281 | B2 * | 4/2008 | Yamaguchi et al. | 200/302.1 |
| 8,050,019 | B2 * | 11/2011 | Wennemer et al. | 361/679.08 |
| 2002/0056627 | A1 * | 5/2002 | Rochon et al. | 200/302.2 |
| 2006/0256510 | A1 * | 11/2006 | Nakasono et al. | 361/679 |

FOREIGN PATENT DOCUMENTS

CN 1862962 A 11/2006

OTHER PUBLICATIONS

Office action mailed on Jun. 4, 2012 for the China application No. 200910158260.0, p. 3 line 8~20.

* cited by examiner

*Primary Examiner* — Edwin A. Leon
(74) *Attorney, Agent, or Firm* — Winston Hsu; Scott Margo

(57) ABSTRACT

A key mechanism for actuating a circuit board includes a housing whereon an opening is formed, a key button installed inside the opening of the housing, and a waterproof structure installed between the key button and the circuit board for preventing fluid from leaking into the circuit board via an interface of the housing and the key button. A space is formed between the waterproof structure and the key button for containing the fluid leaking from the interface of the housing and the key button. The space is lower than the interface of the housing and the key button.

16 Claims, 8 Drawing Sheets

KEY MECHANISM WITH WATERPROOFING FUNCTION AND RELATED ELECTRONIC DEVICE

BACKGROUND OF THE INVENTION

1. Field of the Invention

The present invention relates to a key mechanism and a related electronic device, and more particularly, to a key mechanism with waterproofing function and a related electronic device.

2. Description of the Prior Art

With the advanced technology, structural design of consumer electronic device is complicated and demand of operating environment of the electronic device is strict, so that waterproofing function becomes more important. Preventing damages of the consumer electronic product from exposing to moist surrounding or from leaking fluid is important than before. For example, conventional electronic devices with key mechanism, such as a telephone, a keyboard, a mobile phone, a calculator, and a remote controller, have no perfect design of waterproof structures, so that electronic components of the conventional electronic products are easy to be broken or to short in an accident, such as being doused into water from a collapsed cup. Therefore, design of a key mechanism with perfect waterproofing function is an important issue in mechanical design.

SUMMARY OF THE INVENTION

The present invention provides a key mechanism with perfect waterproofing function and a related electronic device for solving above drawbacks.

According to the claimed invention, a key mechanism includes a housing whereon an opening is formed, a key button installed inside the opening of the housing, and a waterproof structure installed between the key button and a circuit board for preventing fluid from leaking into the circuit board via an interface of the housing and the key button. A space is formed between the waterproof structure and the key button for containing the fluid leaking from the interface of the housing and the key button, and the space is lower than the interface of the housing and the key button.

According to the claimed invention, an electronic device includes a circuit board, and a key mechanism for actuating the circuit board. The key mechanism includes a housing whereon an opening is formed, a key button installed inside the opening of the housing, and a waterproof structure installed between the key button and the circuit board for preventing fluid from leaking into the circuit board via an interface of the housing and the key button. A space is formed between the waterproof structure and the key button for containing the fluid leaking from the interface of the housing and the key button, and the space is lower than the interface of the housing and the key button.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
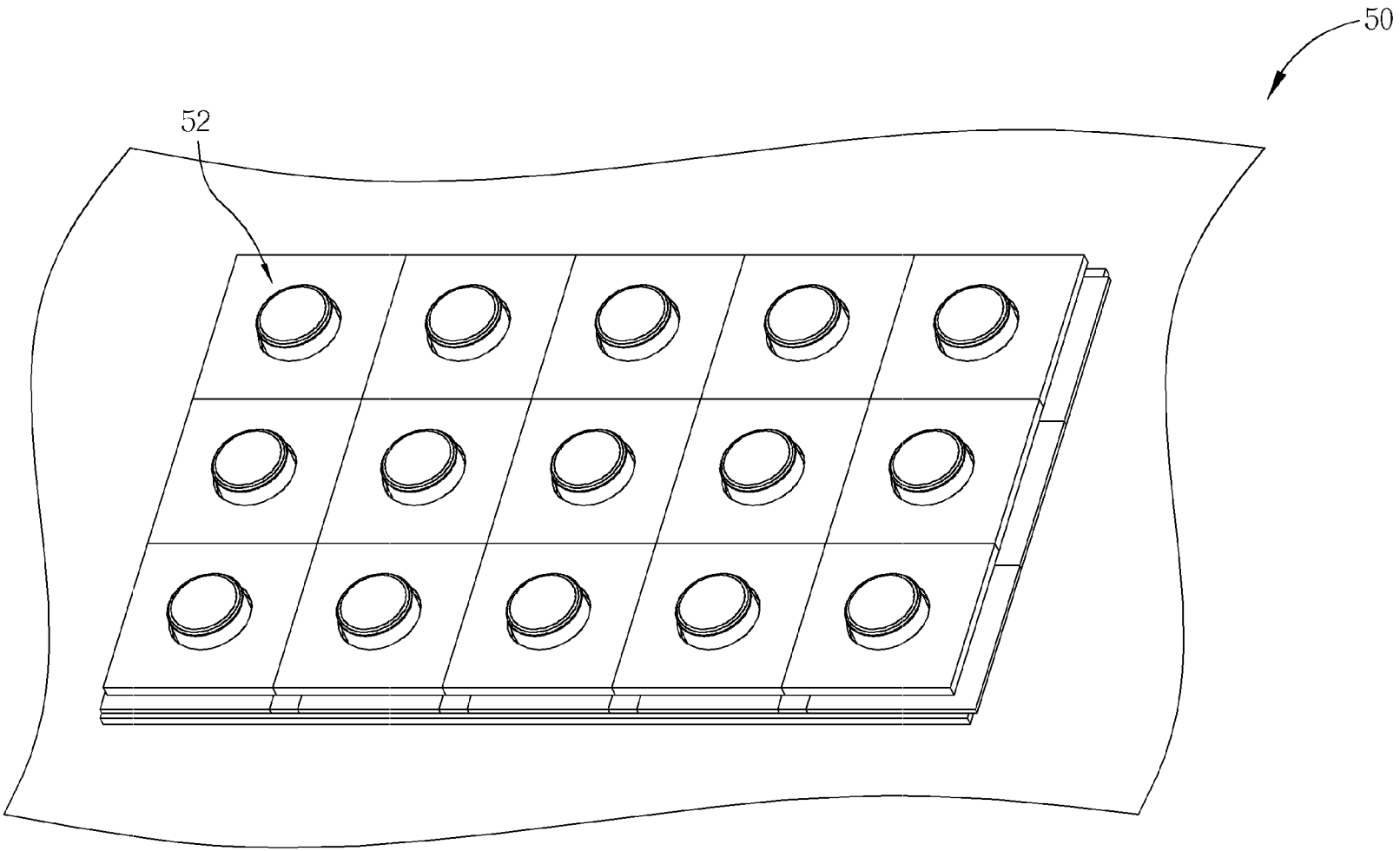
FIG. 1 is a diagram of partial appearance of an electronic device according to a preferred embodiment of the present invention.
Figure 2:
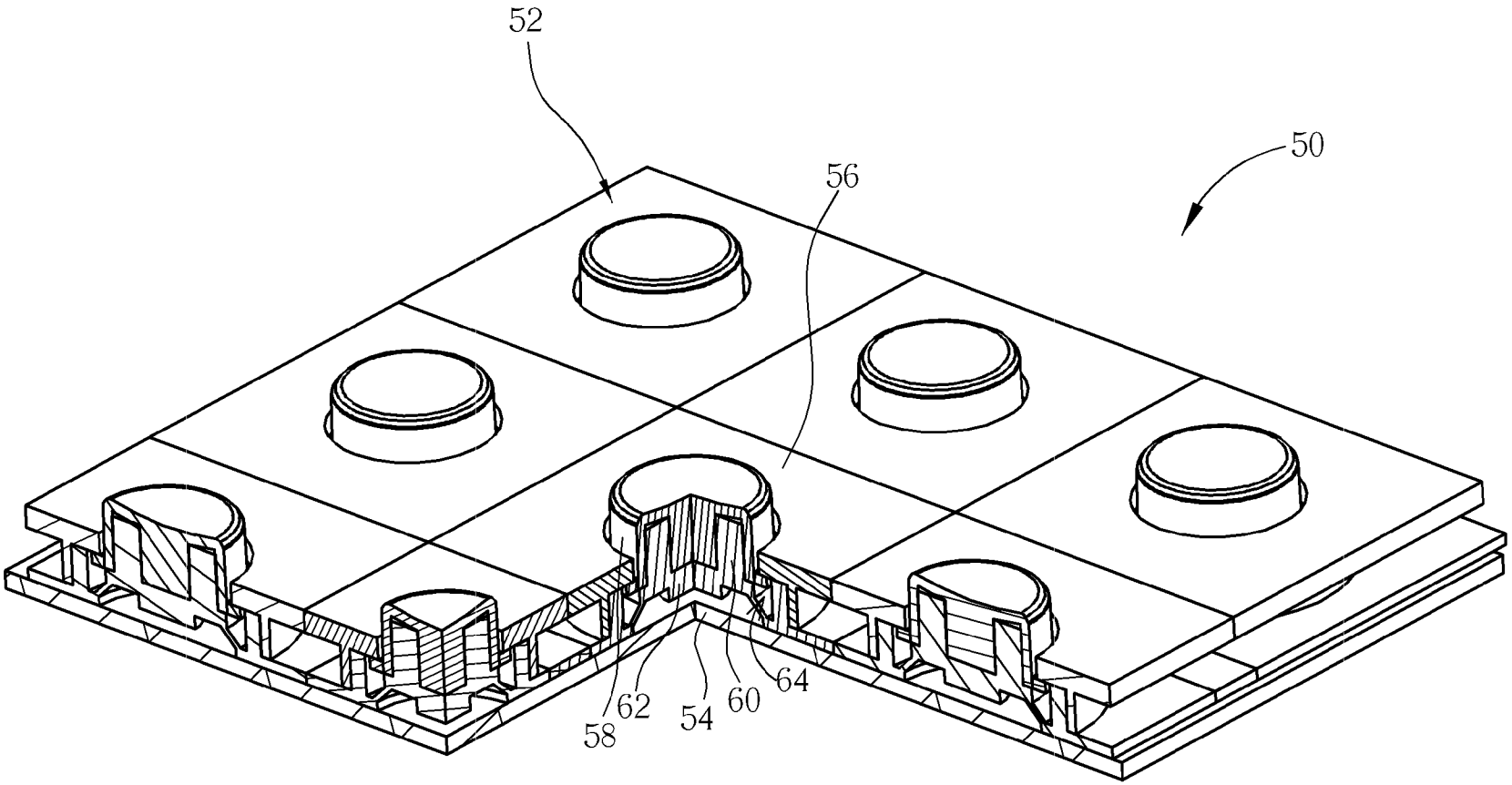
FIG. 2 is a partial sectional view of the electronic device according to the preferred embodiment of the present invention.
Figure 3:
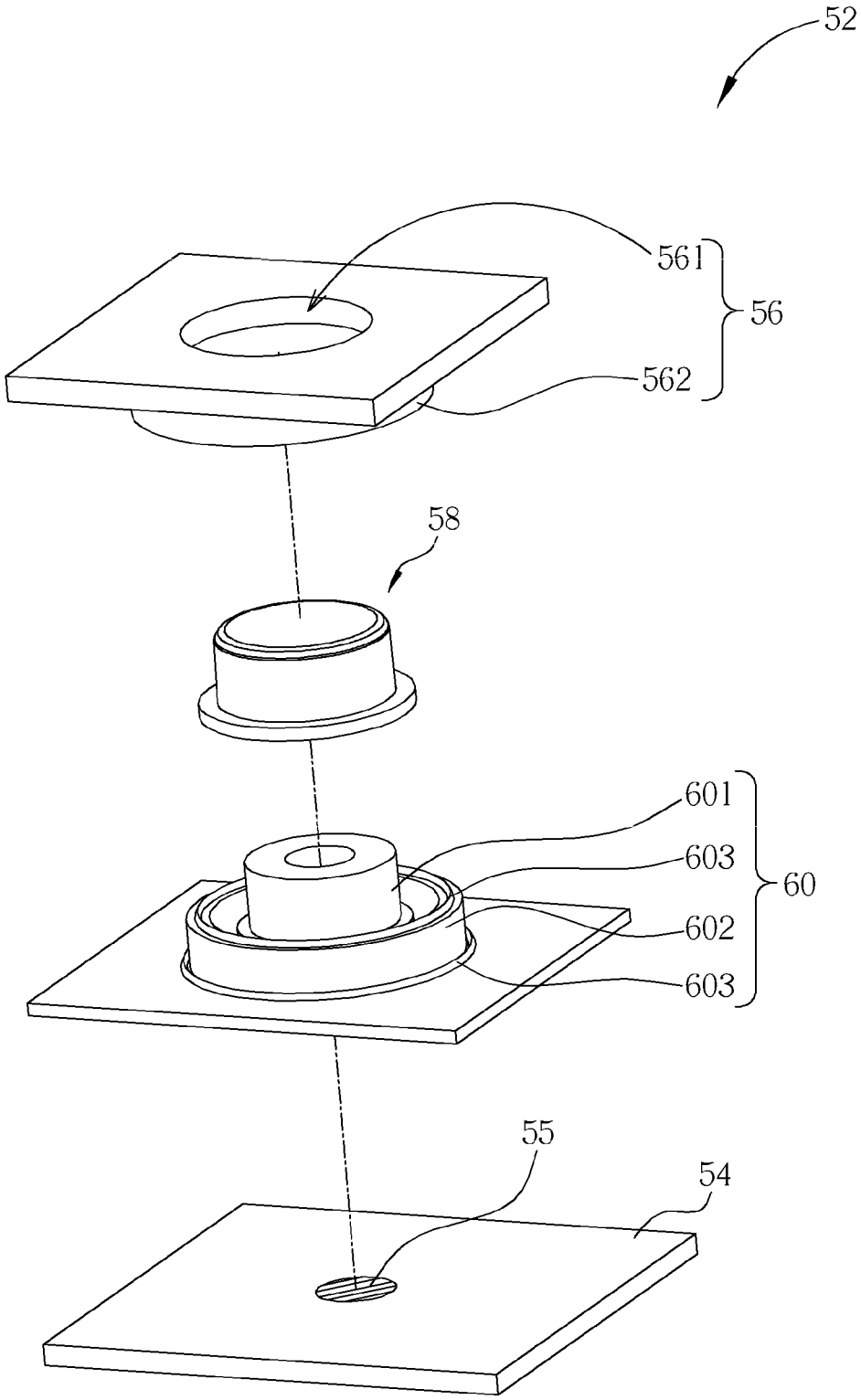
FIG. 3 is an exploded diagram of a key mechanism according to the preferred embodiment of the present invention.
Figure 4:
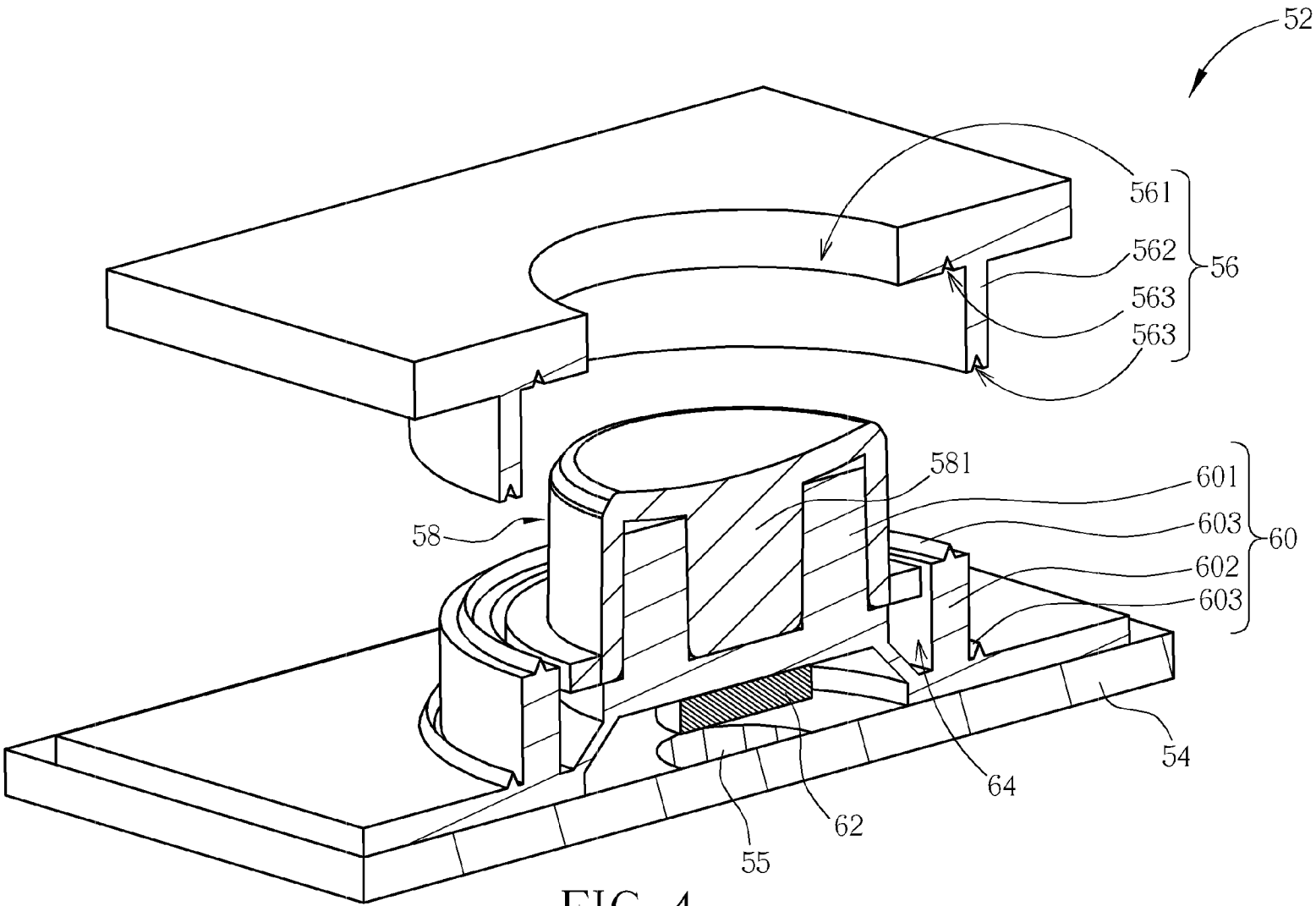
FIG. 4 and FIG. 5 are sectional views of decomposition and combination of the key mechanism according to the preferred embodiment of the present invention, respectively.
Figure 5:
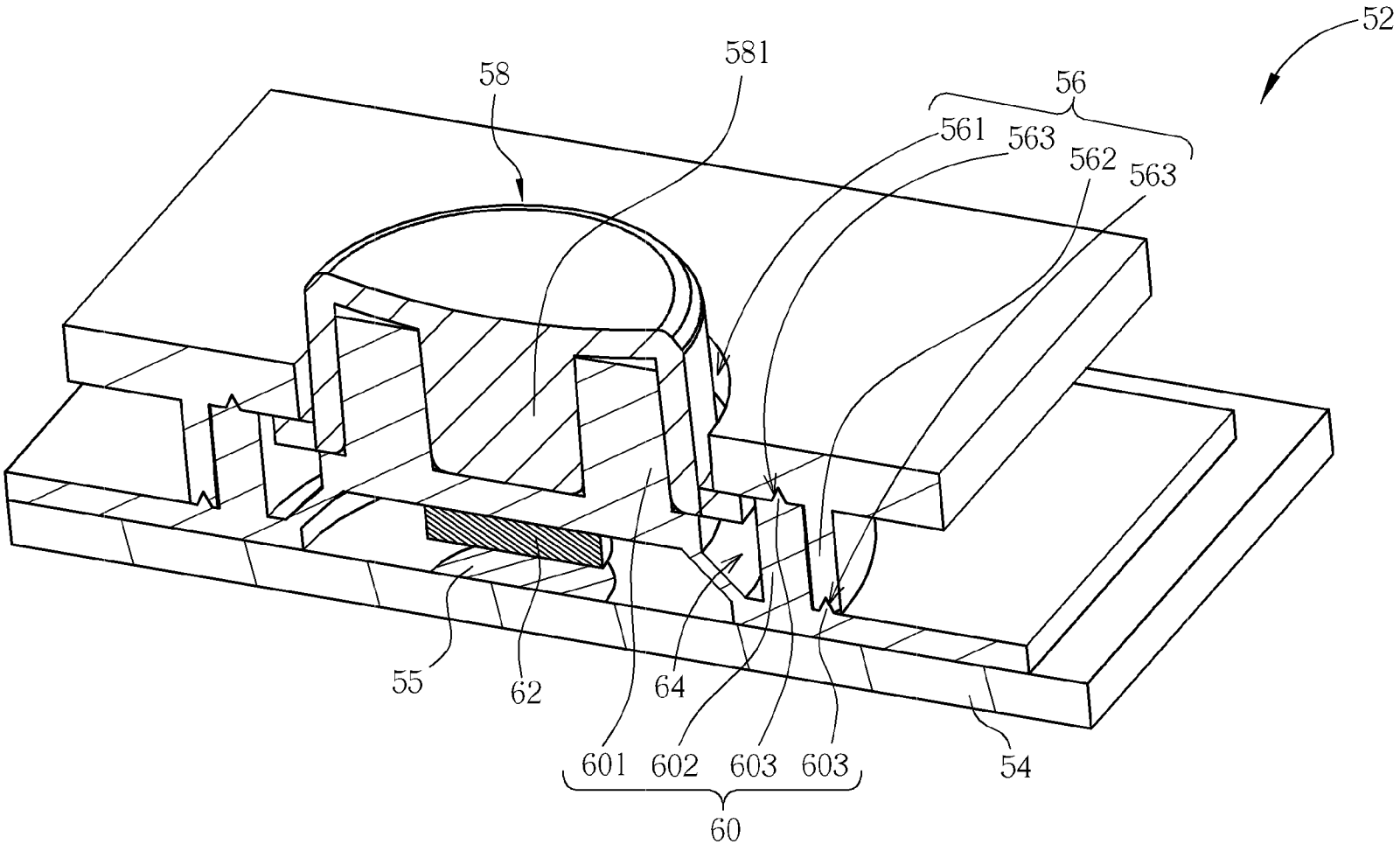

Please refer to FIG. 1. FIG. 1 is a diagram of partial appearance of an electronic device 50 according to a preferred embodiment of the present invention. The electronic device 50 can be a telephone, a computer device, a mobile phone, a calculator, a remote controller, and so on. The electronic device 50 includes at least one key mechanism 52, and a position and a number of the key mechanism 52 are not limited to the embodiment as shown in FIG. 1. Please refer to FIG. 2 to FIG. 5. FIG. 2 is a partial sectional view of the electronic device 50 according to the preferred embodiment of the present invention. FIG. 3 is an exploded diagram of the key mechanism 52 according to the preferred embodiment of the present invention. FIG. 4 and FIG. 5 are sectional views of decomposition and combination of the key mechanism 52 according to the preferred embodiment of the present invention, respectively. The key mechanism 52 is for actuating a circuit board 54 of the electronic device 50. In this embodiment, the circuit board 54 can be a printed circuit board, a flexible circuit board, and so on. At least one metal dome 55 is disposed on the circuit board 54 for outputting a keying signal when the metal dome 55 is actuated.

The key mechanism 52 includes a housing 56 whereon an opening 561 is formed. The key mechanism 52 further includes a key button 58 installed inside the opening 561 of the housing 56. A shape of the opening 561 of the housing 56 and the key button 58 can be matched with each other. For example, the opening 561 can be a circular opening, and the key button 58 can be a circular key button accordingly. The key mechanism 52 further includes a waterproof structure 60 installed between the key button 58 and the circuit board 54 for preventing fluid from leaking into the metal dome 55 of the circuit board 54 via an interface of the housing 56 and the key button 58. The waterproof structure 60 can be an elastic structure. For example, the waterproof structure 60 can be made of rubber material or silica gel material. The key button 58 can be embedded between the housing 56 and the waterproof structure 60. For example, the waterproof structure 60 can include a pillar 601, and a cavity is formed inside the pillar 601. The key button 58 can includes a protrusion 581 embedded inside the cavity of the pillar 601. Therefore, when the key button 58 is pressed, the waterproof structure 60 can be driven to be pressed and deformed. The pillar can further be disposed on the key button 58, and the protrusion 581 can further be disposed on the waterproof structure 60 accordingly. Structural design for combining the key button 58 and the waterproof structure 60 is within the scope of the present invention. When the key button 58 is not pressed, the waterproof structure 60 with elasticity can provide an elastic recovering force to the key button 58, so as to drive the key button 58 to an initial position. The key mechanism 52 further includes an actuator 62 for actuating the metal dome 55. The actuator 62 can be made of conductive material, such as a carbon pill, for contacting an end of the metal dome 55. When the key button 58 is pressed, the actuator 62 connected to the waterproof structure 60 can be driven downwardly so as to conduct the metal dome 55 to output the corresponding keying signal. In addition, a plurality of metal domes 55 can be disposed on the circuit board 54, and the key mechanism 52 can include a plurality of actuators 62 respectively located in positions above the plurality of metal domes 55 for actuating the plurality of metal domes 55 respectively.

The waterproof structure 60 further includes a waterproof wall 602 disposed around the pillar 601. The waterproof wall 602 can be an annular structure, a square structure, a polyhedral structure, and so on. The waterproof structure 60 can include more than one waterproof wall 602, which means a plurality of waterproof walls 602 can be disposed concentrically for improving waterproofing function, and it depends on design demand. As mentioned above, a space 64 can be formed between the key button 58, the waterproof wall 602, and the pillar 601. When the fluid leaks into the housing 56 via the interface of the housing 56 and the key button 58, the space 64 can be for containing the fluid leaking via the interface of the housing 56 and the key button 58, so that the fluid can not contact the metal dome 55 of the circuit board 54. Because the space 64 is lower than the interface of the housing 56 and the key button 58, the leaking fluid can not leak into other places of the housing 56 easily. That is to say, the space 64 can be a watertight division for blocking the fluid inside effectively. When the space 64 is filled with the fluid, the fluid can be drained away via a gap between the key button 58 and the housing 56, which is formed by inverting the key mechanism 52 and pressing the key button 58 or inverting the key mechanism 52 directly.

Figure 6:
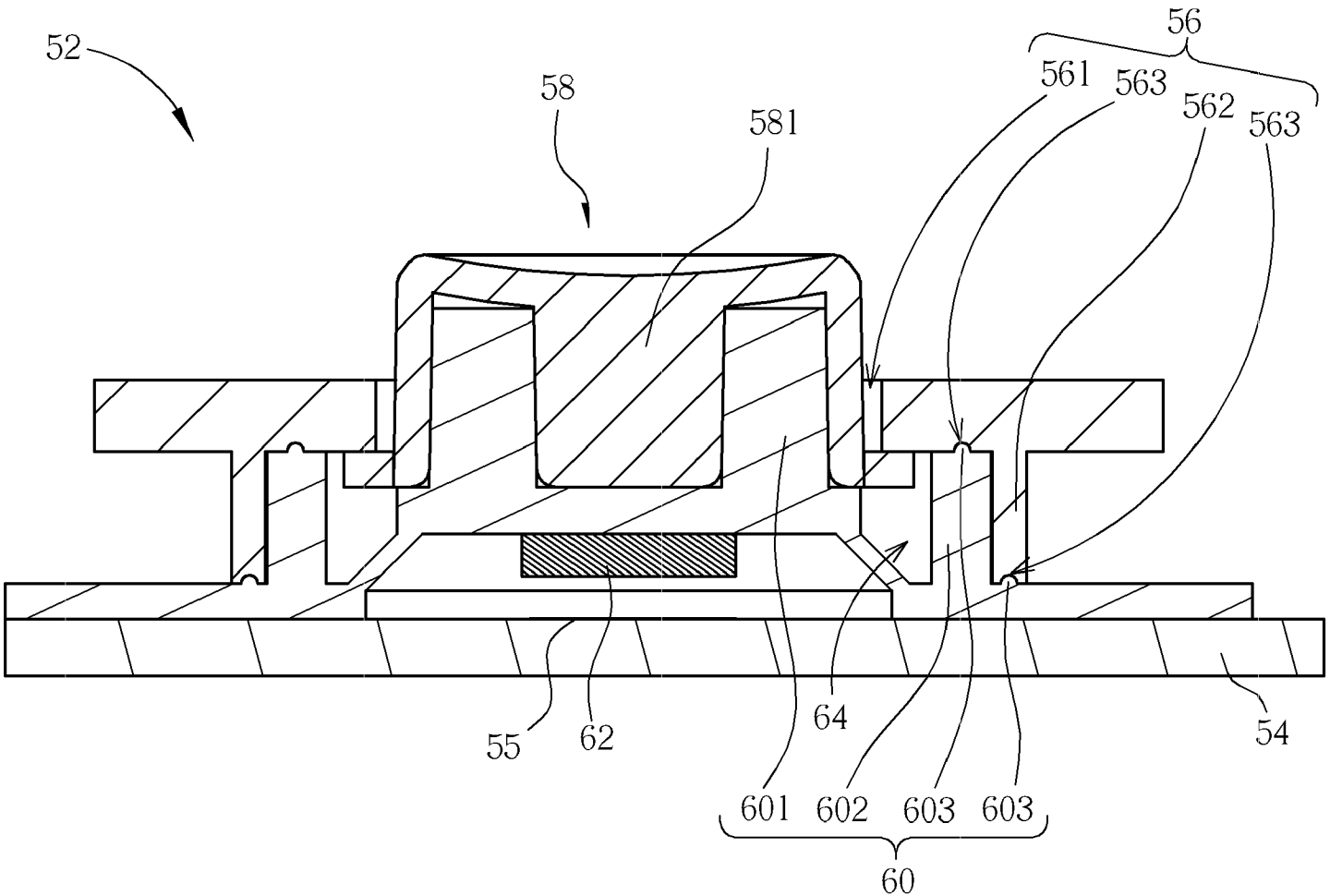
FIG. 6 is a sectional view of the key mechanism according to another preferred embodiment of the present invention.

In order to enhance the waterproofing function, the housing 56 can includes a sheath 562, which can be integrated with the housing 56 monolithically. The sheath 562 is disposed around the waterproof wall 602 of the waterproof structure 60. At least one slot 563 can be formed on a side of the housing 56 facing to the circuit board 54 and on the sheath 562, and at least one waterproof rib 603 can be formed on the waterproof structure 60 and the waterproof wall 602, which is respectively disposed on a position corresponding to the slot 563. In this embodiment, two slots 563 are formed on the housing 56 and two waterproof ribs 603 are formed on the waterproof structure 60 accordingly. Positions and numbers of the slot 563 and the waterproof rib 603 are not limited to the embodiment, and it depends on design demand. The waterproof rib 603 can be embedded inside the slot 563 in a tight fit manner so as to prevent the fluid from leaking into other places of the housing 56 effectively. In this embodiment, the waterproof rib 603 can be a V-shaped protruding rib, the slot 563 can be a V-shaped slot accordingly. Shapes of the waterproof 603 and the slot 563 are not limited to the above-mentioned embodiment. For example, please refer to FIG. 6, FIG. 6 is a sectional view of the key mechanism 52 according to another preferred embodiment of the present invention. In this embodiment, the waterproof rib 603 can be an arc protruding rib, the slot 563 can be an arc slot accordingly, and shapes of the waterproof 603 and the slot 563 can depend on the actual demand. In addition, the tight fit combination of the waterproof rib 603 and the slot 563 of the present invention can be exchanged, which means the waterproof rib 603 can be disposed on the housing 56 and the slot 563 can be disposed on the waterproof structure 60 accordingly. The operational principle is the same as the one according to above-mentioned embodiment, and detail description is omitted herein fro simplicity.

Figure 7:
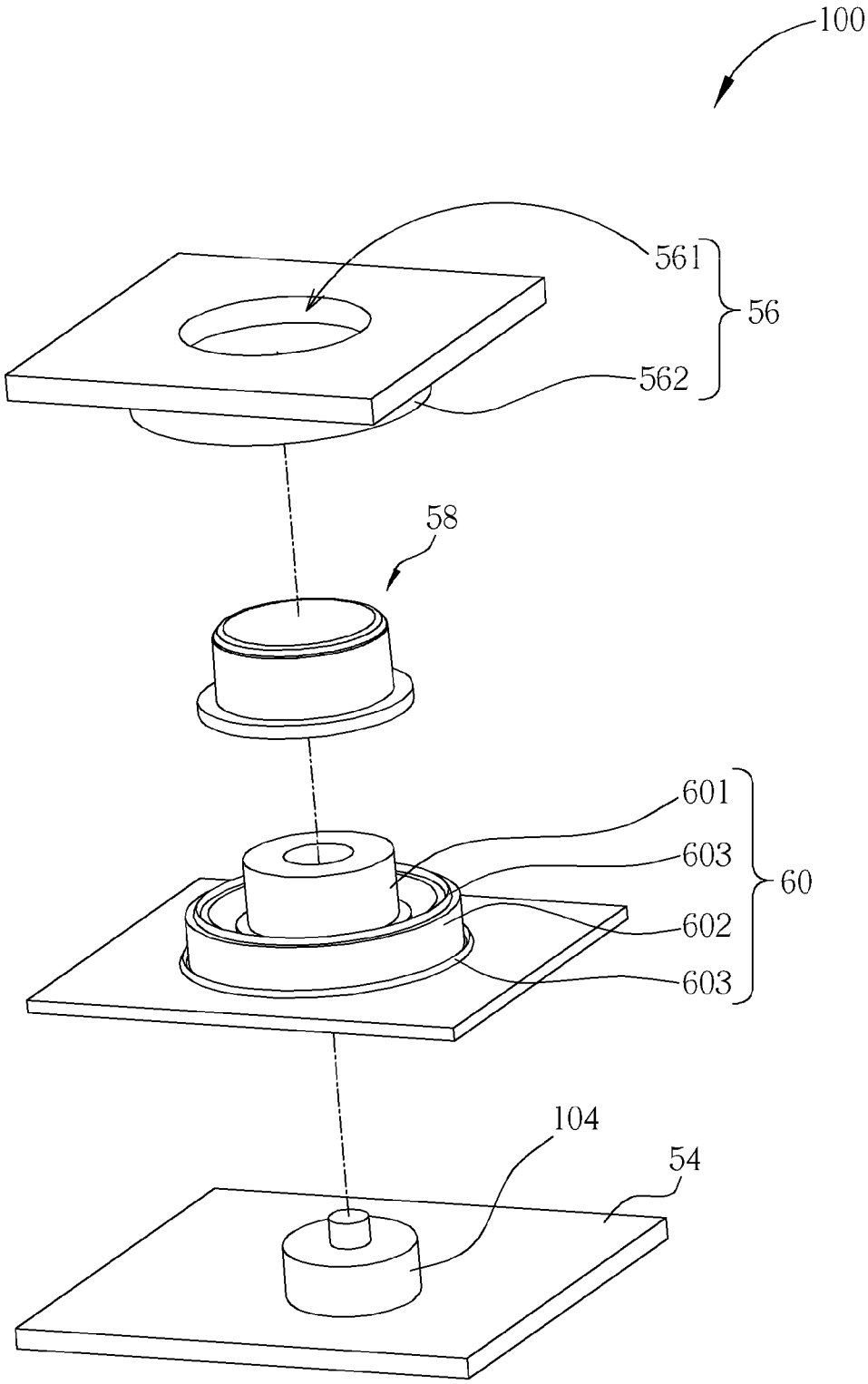
FIG. 7 is an exploded diagram of a key mechanism according to another preferred embodiment of the present invention.
Figure 8:
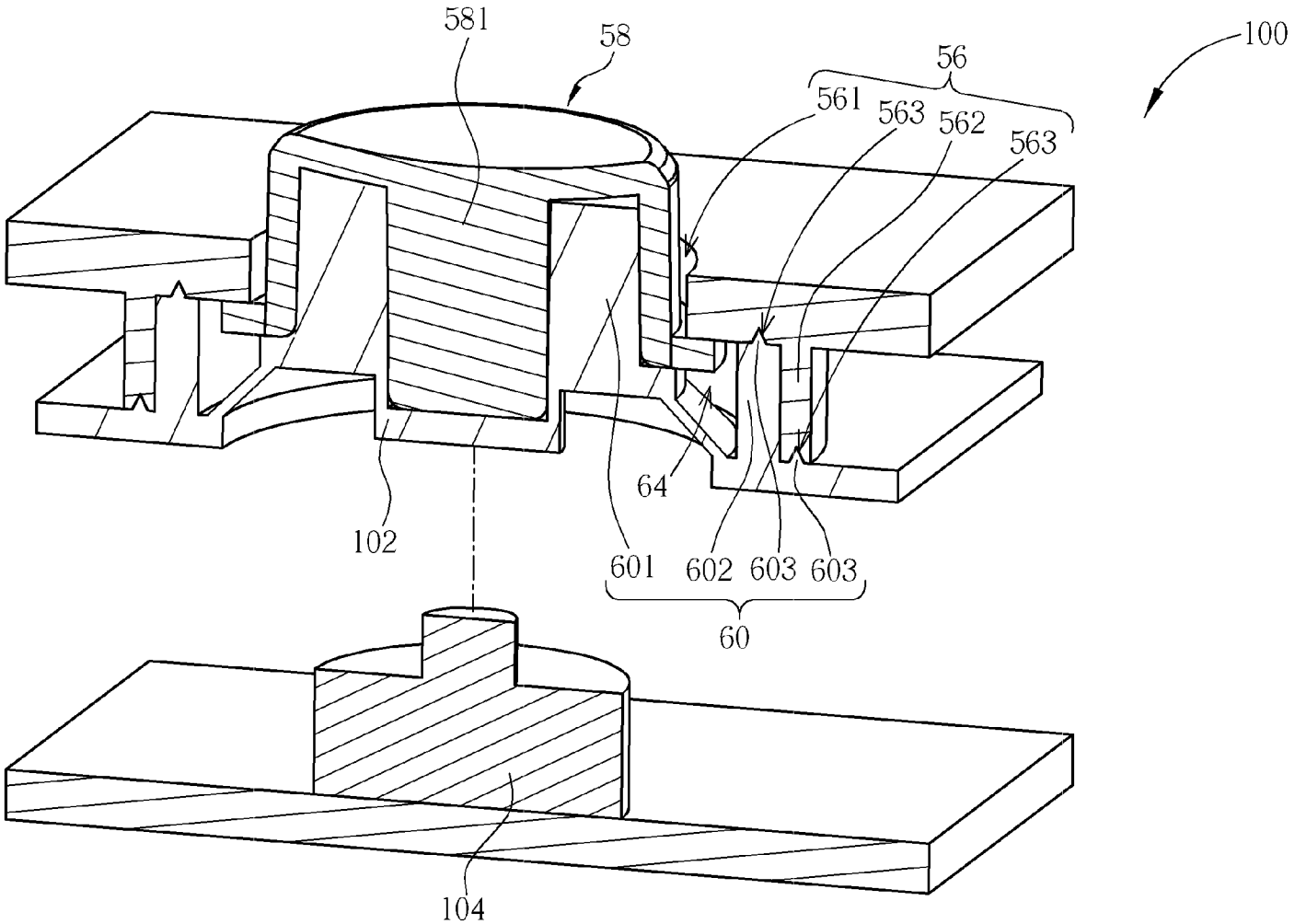
FIG. 8 is a sectional view of the key mechanism shown in FIG. 7 of the present invention.

Furthermore, the key mechanism 52 can be suitable for actuating a switch device, such as being for actuating a power switch. Please refer to FIG. 7 and FIG. 8. FIG. 7 is an exploded diagram of a key mechanism 100 according to another preferred embodiment of the present invention. FIG. 8 is a sectional view of the key mechanism 100 shown in FIG. 7 of the present invention. In this embodiment, components having the same numerals as ones of the above-mentioned embodiment have the same structures and functions, and detail description is omitted herein fro simplicity. Difference between this embodiment and the above-mentioned embodiment is that an actuator 102 of the key mechanism 100 is for pressing a switch 104 of the circuit board 54. That is to say, when the key button 58 is pressed, the actuator 102 connected to the waterproof structure 60 can be driven downwardly so as to press the switch 104 to output the corresponding keying signal. In addition, a plurality of switches 104 can be disposed on the circuit board 54, and the key mechanism 52 can include a plurality of actuators 102 respectively disposed above the plurality of switches 104, for actuating the plurality of switches 104 respectively.

Comparing to the prior art, the key mechanism of the present invention can block the fluid from leaking into the circuit board effectively so as to provide a prefect waterproof protection to the electronic devices. Internal components of the electronic devices can avoid damage even being drowned by the fluid in an accident.

Those skilled in the art will readily observe that numerous modifications and alterations of the device and method may be made while retaining the teachings of the invention.

What is claimed is:

1. A key mechanism comprising:

a housing whereon an opening is formed;

a key button installed inside the opening of the housing; and a waterproof structure installed between the key button and a circuit board for preventing fluid from leaking into the circuit board via an interface of the housing and the key button, the waterproof structure comprising a waterproof wall disposed around the key button, a space being formed between the waterproof wall and the key button for containing the fluid leaking from the interface of the housing and the key button, the space being lower than the interface of the housing and the key button, at least one first slot or at least one first waterproof rib being formed on a side of the housing facing to the circuit board, and the corresponding at least one first waterproof rib or the corresponding at least one first slot being formed on the waterproof wall and disposed on a position corresponding to the at least one first slot or the at least one first waterproof rib for engaging with the at least one first slot or the at least one first waterproof rib so as to prevent the fluid from leaking.

2. The key mechanism of claim 1, wherein the opening of the housing is a circular opening, and the key button is a circular key button.

3. The key mechanism of claim 1, wherein at least one second slot is formed on a side of the housing facing to the circuit board, and at least one second waterproof rib is formed on the waterproof structure and disposed on a position corresponding to the at least one second slot for embedding inside the at least one second slot so as to prevent the fluid from leaking.

4. The key mechanism of claim 3, wherein the at least one second waterproof rib is embedded inside the at least one second slot in a tight fit manner.

5. The key mechanism of claim 3, wherein the at least one second waterproof rib is a V-shaped protruding rib, and the at least one second slot is a V-shaped slot.

6. The key mechanism of claim 3, wherein the at least one second waterproof rib is an arc protruding rib, and the at least one second slot is an arc slot.

7. The key mechanism of claim 1, wherein at least one second waterproof rib is formed on a side of the housing facing to the circuit board, at least one second slot is formed on the at least one second waterproof structure and disposed on a position corresponding to the at least one second waterproof rib, and the at least one second waterproof rib is for embedding inside the at least one second slot so as to prevent the fluid from leaking.

8. The key mechanism of claim 7, wherein the at least one second waterproof rib is embedded inside the slot in a tight fit manner.

9. The key mechanism of claim 1, wherein the key button is embedded between the housing and the waterproof structure.

10. The key mechanism of claim 9, wherein the waterproof structure comprises a pillar, and the key button comprises a protrusion embedded inside the pillar.

11. The key mechanism of claim 1, wherein the housing comprises a sheath disposed around the waterproof wall of the waterproof structure.

12. The key mechanism of claim 11, wherein the at least one first slot or the at least one first waterproof rib is formed on the sheath of the housing.

13. The key mechanism of claim 1, wherein the waterproof structure is an elastic structure.

14. The key mechanism of claim 1 further comprising:

an actuator installed on a side of the waterproof structure for actuating the circuit board.

15. The key mechanism of claim 14, wherein the actuator is made of conductive material.

16. An electronic device comprising:

a circuit board; and a key mechanism for actuating the circuit board, the key mechanism comprising:

a housing whereon an opening is formed;

a key button installed inside the opening of the housing; and a waterproof structure installed between the key button and the circuit board for preventing fluid from leaking into the circuit board via an interface of the housing and the key button, the waterproof structure comprising a waterproof wall disposed around the key button, a space being formed between the waterproof wall and the key button for containing the fluid leaking from the interface of the housing and the key button, the space being lower than the interface of the housing and the key button, at least one first slot or at least one first waterproof rib being formed on a side of the housing facing to the circuit board, and the corresponding at least one first waterproof rib or the corresponding at least one first slot being formed on the waterproof wall and disposed on a position corresponding to the at least one first slot or the at least one first waterproof rib for engaging with the at least one first slot or the at least one first waterproof rib so as to prevent the fluid from leaking.

* * * * *